United States Patent [19]

Rosenthal

[11] 3,994,048

[45] *Nov. 30, 1976

[54] TIE

[76] Inventor: Allen M. Rosenthal, 6 Northstar St., Marina Del Rey, Calif. 90291

[ * ] Notice: The portion of the term of this patent subsequent to Apr. 6, 1993, has been disclaimed.

[22] Filed: Mar. 8, 1976

[21] Appl. No.: 664,732

Related U.S. Application Data

[63] Continuation-in-part of Ser. No. 500,422, Aug. 26, 1974, Pat. No. 3,947,927.

[52] U.S. Cl. ..... 24/81 SK; 24/16 R; 24/204; 24/81 CC; 24/73 SG; 224/45 S

[51] Int. Cl.[2] ..... A44B 21/00; B65D 63/00

[58] Field of Search ..... 24/73 A, 73 SA, 16 PB, 24/81 SK, 73 SG, 16 R, DIG. 18, 204, 81 CC; 224/45 S, 52; 47/42, 46, 44; 180/11.37 A

[56] References Cited

UNITED STATES PATENTS

| | | | |
|---|---|---|---|
| 3,307,872 | 3/1967 | Murcott | 24/DIG. 18 |
| 3,430,299 | 3/1969 | Copen | 24/16 R |
| 3,486,672 | 12/1969 | Esopi | 24/81 SK |
| 3,653,565 | 4/1972 | McAusland | 224/45 S |

*Primary Examiner*—Bernard A. Gelak
*Attorney, Agent, or Firm*—Nilsson, Robbins, Dalgarn & Berliner

[57] ABSTRACT

A tie useful for securing together a pair of skis and a pair of ski poles for ease of carrying them as one unit with the poles acting as a carrying handle. The tie includes an elongate, flexible tape having opposite free end segments which matingly engage adjacent portions of a central segment on the same tape via filamentary loops and hooks. Eyes are distally carried by lengths of strap material secured to the opposite tape side. The free tape end segments are threadable through the eyes and are bent back and coupled to the central segment to form a figure eight, the loops of which separately enclose the skis and poles.

6 Claims, 4 Drawing Figures

FIG. 1
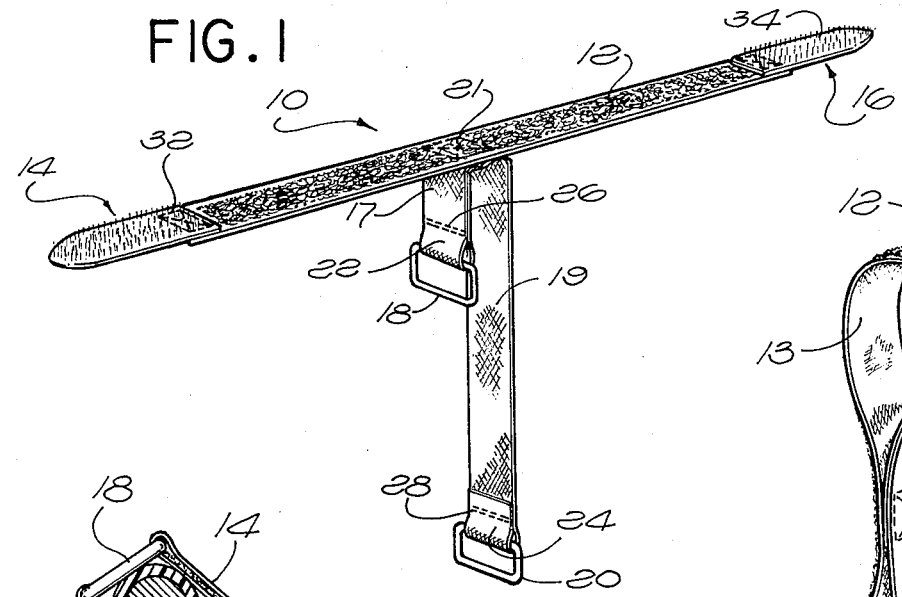
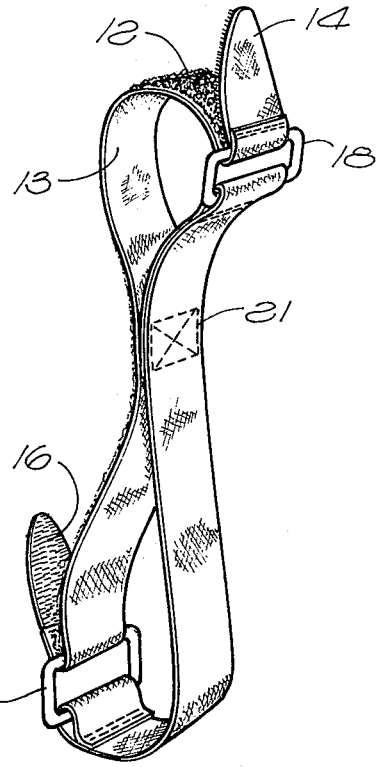
FIG. 2
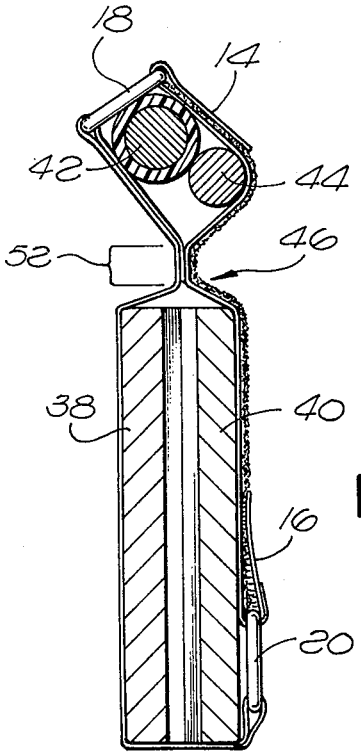
FIG. 4
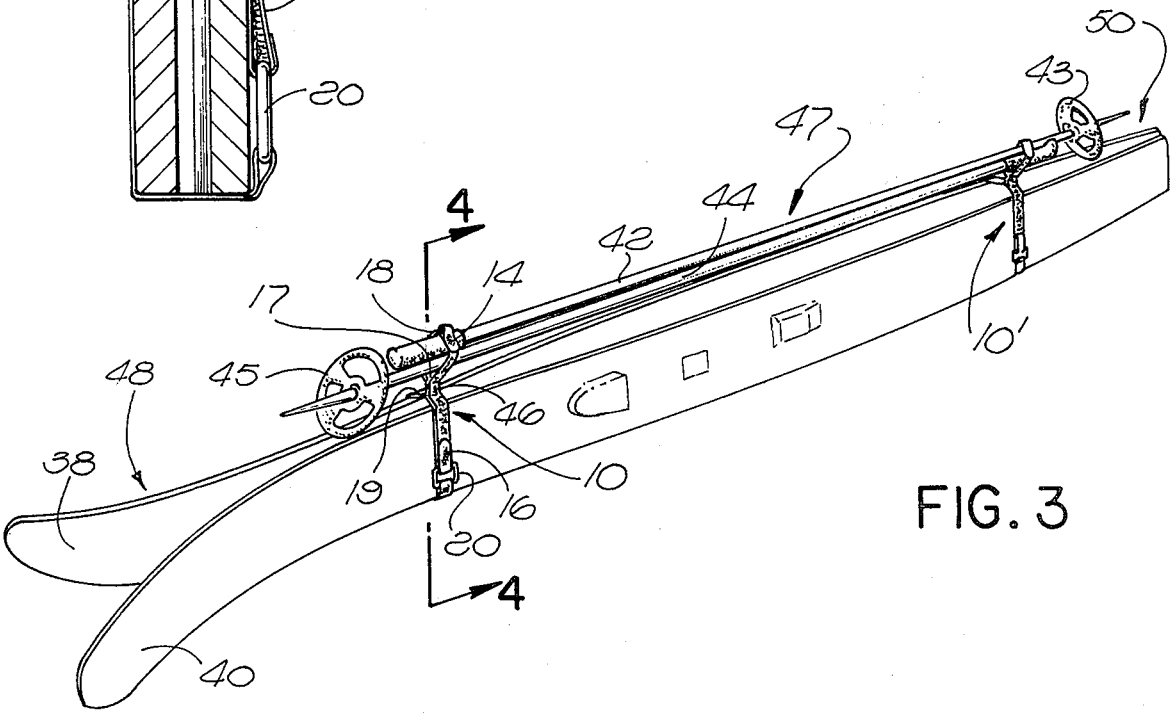
FIG. 3

TIE

CROSS-REFERENCE TO RELATED APPLICATION

This application is a continuation-in-part of application Ser. No. 500,422, filed Aug. 26, 1974, now U.S. Pat. No. 3,947,927.

BACKGROUND AND SUMMARY OF THE INVENTION

In carrying ski equipment, particularly over the long distances from parking lot to ski lift, it is desirable to be able to tie the equipment together to form a compact bundle that can be carried in one hand by means of a handle. Conventional ties are only suitable for holding skis together, are bulky and awkward to use and, because of angular metal parts, are difficult and, indeed, dangerours to carry while skiing. In my prior application Ser. No. 500,422, I describe a tie which readily assembles to securely strap any size skis and poles together, which is rapidly released, and which is easily and safely carried about when not in use. The tie comprises an elongate, flexible tape having opposite free end segments which matingly engage adjacent portions of a central segment on the same tape side via coupling surfaces formed of interengagable filamentary loops and hooks. The free end segments are threaded through respective ones of a pair of eyes operable on the opposite tape side, are bent back, cinched tightly and coupled to the central segment to form a figure eight, the loops of which separately enclose the skis and poles.

Material formed with such loops or hooks is relatively costly. The present invention provides a tie which uses substantially less such material by extending the eyes by means of elongate lengths of bare strap material. In particular, the eyes are distally carried by strap material secured to the aforesaid opposite tape side.

A pair of ties can be used to secure the opposite ends of an assembly of a pair of skis and a pair of poles. When not in use, each tie can be simply wrapped around a ski pole and secured thereon by its own coupling surfaces, or safely carried unobtrusively in one's pocket. When the skis are stored, the ties can be used in single loop fashion to secure them together without affecting the camber of the skis. Prior art cited in prosecution of my prior application Ser. No. 500,422 is U.S. Pat. Nos. 3,486,672 to Esopi, 3,430,299 to Copen, 3,653,565 to McAusland and 3,307,872 to Murcott.

BRIEF DESCRIPTION OF THE DRAWINGS

FIG. 1 is a perspective view of a tie according to the present invention;

FIG. 2 is a perspective view of the tie of FIG. 1 formed into a figure eight configuration;

FIG. 3 is a perspective view of a pair of skis and a pair of ski poles strapped together with ties of this invention; and FIG. 4 is a view on line 4—4 of FIG. 4.

DETAILED DESCRIPTION

Referring now to FIG. 1, in one embodiment, a tie 10 of the present invention is in the form of an elongate strip of flexible tape material which can be of cloth, polymer yarn, plastic or the like, and is exemplified by a nylon tape. The strip includes a central segment 12 and two free end segments 14 and 16 integrally connected thereto. The upper surface of each end segment

14 and 16 is provided with means which couple with conjugate means on the upper surface of the central segment 12. In the present illustration, the upper surface of each end segment 14 and 16 consists of a multiplicity of small filamentary hook members of curled or crinkled configuration constituting a sort of mat surface. The upper surface of the central segment 12 is formed of a mating surface consisting of a multiplicity of small loops made of filamentary material, the material being stiff enough so that the loops project outwardly from the face of the tape. The two types of surfaces display the property that when they are brought into juxtaposition, a number of the individual filamentary hook members become intertwined with the outwardly projecting loops and thereby retain the parts in coupled or fastened relation. Preferably, the interengaging surfaces are those incorporated in fastening tapes sold commercially under the trademark "VELCRO" by Velcro Corp., New York, New York. In this regard, one or more of the following VELCRO U.S. Patents can be of interest: U.S. Pat. Nos. 2,717,437, 3,000,084, 3,009,235, 3,076,244, 3,130,111, 3,147,528, 3,154,837, 3,192,589 and 3,387,345.

The surfaces may be readily separated from one another by peeling apart, but when fastened, they strongly resist longitudinal movement. For convenience of reference, the surfaces of the end segments 14 and 16, with their individual filamentary hook members forming mats, may be referred to as male surfaces, while the surface of the central segment 12 with its multiplicity of loops of filamentary material may be referred to as a female surface.

Referring further to FIG. 1, the present tie also includes a pair of eyes 18 and 20, each formed of metal or plastic loops. Each eye 18 and 20 is connected to the central segment 12 so as to be operable on the smooth side 13 (FIG. 2) of the tape, opposite the filamentary material; i.e., the eyes 18 and 20 serve as loops for the end segments 14 and 16 whereby the end segments 14 and 16 can be doubled back, cinched tightly and coupled to the central segment 12 to form the loops of a figure eight. The eyes 18 and 20 are secured at the distal ends of elongate lengths 17 and 19 of strap material. The strap material is secured, such as by stitches 21, to the smooth tape side 13 intermediate the end segments 14 and 16. The lengths 17 and 19 of strap material can be defined by the ends of a single piece of material, as shown, or can be individual pieces separately secured to the smooth tape side 13. In either case, the proximal regions of the resultant lengths 17 and 19 are secured so as to be spaced longitudinally from the end segments 14 and 16 and from at least a portion of the adjacent mating surfaces therefor of the central region 12. In the embodiment illustrated, the strap material lengths 17 and 19 are located closely adjacent one to the other approximately midway of the length of the tie.

One length 19 of strap material can be substantially longer than the other length 17, in this embodiment at least twice as long. By such configuration, loops of appropriate different sizes can be formed, as will be described hereinafter, for securement of skis and ski poles, respectively and to each other. The lengths 17 and 19 of strap material can be formed of any desired flexible substance such as cloth, polymer yarn, plastic or the like, a particularly useful material being polypropylene webbing.

The eyes 18 and 20 are secured to the distal lengths 17 and 19 of strip material by passing the strap material through the respective eye and forming retaining loops 22 and 24 by stitching such as at 26 and 28.

In the embodiment shown in FIG. 1, the end segments 14 and 16 are joined to the central segments 12 by stitching 32 and 34. Alternatively, the end segments 14 and 16 can be joined to the central segment 12 by means of heat-sealing adhesive, as known, applied to a top surface portion of the central segment 12 from which the filamentary female surface has been removed (or which is originally manufactured with a bare surface). It will be appreciated that a reverse configuration can be used and that the other junctions which are illustrated in FIG. 1 as stitched can also be connected by the use of heat-sealing adhesive or the like.

Referring now to FIG. 2, to form a figure eight configuration, each end segment 14 and 16 is threaded through an eye 18 and 20, respectively, and doubled back so that its male surface matingly confronts the adjacent female surface of the central segment 12.

Referring to FIG. 3, there is illustrated the manner of securement of a pair of skis 38 and 40 and ski poles 42 and 44. The end segment 14 of the tie 10 is wrapped around the poles 42 and 44, threaded through its eye 18, doubled back, cinched tightly, and secured against an adjacent female portion of the central segment 12. In like manner, the end segment 16 of the tie 10 is wrapped around one end of the skis 38 and 40, threaded through its eye 20, doubled back, cinched tightly, and secured against an adjacent female portion of the central segment 12. In similar manner, the opposite ends of the ski poles 42 and 44 and skis 38 and 40 are secured by a second tie 10'.

The length of tape segment 12 between the proximal ends of the strap material lengths 17 and 19 constitutes a spacer segment 46 separating the skis and poles. Its length is such as to cause the baskets 43 and 45 of the poles 42 and 44, repectively, to pull tightly against the edge of the skis 38 and 40, flexing about its rubber or leather axle. The result is a firm securement of the poles to the skis. Additionally, the loner strap material length 19 should be sufficiently long so that the eye 20 thereon is located along a side of one of the skis when the spacer segment 46 is positioned over the center of the two skis 38 and 40 and the tie 10 is tightly cinched.

Referring additionally to FIG. 4, I have found that for a wide variety of pole basket shapes and skis, a suitable dimension for the spacer segment 46 is about ½ inch as indicated at 52. A desirable length for the longer strap material length 19 is 3 inches or more. For a particular embodiment, the length which bears the female portion of the tie is about 7½ and that of each male free end segment 14 and 16 is about 1¾ inches. Tapes ½ inch to 2 inches wide can be used. The result is a compact, rigidly secured bundle which can be gripped centrally by the poles, e.g. at 47, and carried. When it is desired to untie the equipment, the ties 10 and 10' are merely peeled apart and can then be wrapped around the tops of the poles 42 or 44 or else are easily carried in a pocket. Additionally, when it is desired to store the skis 38 and 40, the ties can be used as simple straps, securing the skis 38 and 40 together at their ends, e.g. at 48 and 50, thereby preserving the camber of the skis.

I claim:

1. A tie, comprising:

an elongate flexible tape having opposite free end segments and a central segment therebetween, each free end segment and a respective portion of said central segment adjacent thereto having, on a first side of said tape, interengagable surface portions including a first surface portion provided with a multiplicity of male hook-shaped filamentary members and a second surface portion provided with a multiplicity of female loop-shaped filamentary members releasably interengagable with said male filamentary members; and first and second eyes for receiving therethrough respective ones of said free end segments;

means for securing said eyes on said central segment between said free end segments on a second side of said tape whereby first and second enclosures, respectively, can be formed by threading said free end segments through said first and second eyes, respectively, for retention by engagement of their filamentary surfaces with the filamentary surfaces of respective adjacent portions of said central segment, said securing means comprising a length of elongate strap material, having a substantially greater length than width, secured to said second tape side and distally carrying one of said eyes a first predetermined distance from said second tape side.

2. The tie of claim 1 including a second length of strap material secured to said second tape side and distally carrying the other of said eyes a second predetermined distance from said second tape side.

3. The tie of claim 2 wherein said first predetermined distance is at least twice said second predetermined distance.

4. The tie of claim 1 wherein said first predetermined distance is at least 3 inches.

5. The tie of claim 2 wherein the lengths of strap material carrying said eyes are secured to said second tape side spaced longitudinally thereon one from the other to define a spacer segment therebetween.

6. The tie of claim 5 wherein the length of said spacer segment is about ½ inch.

* * * * *